US010368394B2

(12) United States Patent
Shearer et al.

(10) Patent No.: US 10,368,394 B2
(45) Date of Patent: Jul. 30, 2019

(54) PTC HEATER WITH AUTONOMOUS CONTROL

(71) Applicant: Hamilton Sundstrand Corporation, Charlotte, NC (US)

(72) Inventors: Jon Shearer, Hartville, OH (US); Carl Aeschliman, Rittman, OH (US); George F. Owens, Akron, OH (US); Kevin Edward Roach, Stow, OH (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 338 days.

(21) Appl. No.: 15/254,209

(22) Filed: Sep. 1, 2016

(65) Prior Publication Data

US 2018/0063886 A1 Mar. 1, 2018

(51) Int. Cl.

*H05B 1/02* (2006.01)
*H05B 3/00* (2006.01)
*H05B 3/26* (2006.01)

(52) U.S. Cl.

CPC ..... *H05B 1/02* (2013.01); *H05B 3/0014* (2013.01); *H05B 3/26* (2013.01); *H05B 2203/013* (2013.01); *H05B 2203/02* (2013.01); *H05B 2203/026* (2013.01)

(58) Field of Classification Search

CPC ..... H05B 1/02; H05B 3/0014; H05B 3/12; H05B 3/14; H05B 2203/013; H05B 2203/02; H05B 2203/026; H05B 3/26
USPC ..... 219/505, 202, 497, 494, 504
See application file for complete search history.

(56) References Cited

U.S. PATENT DOCUMENTS

| | | | | |
|---|---|---|---|---|
| 3,826,924 | A * | 7/1974 | Plough | H01C 7/021 307/117 |
| 6,834,159 | B1 | 12/2004 | Schramm | |
| 7,557,330 | B2 | 7/2009 | Shearer | |
| 8,367,986 | B2 | 2/2013 | Von Wachenfeldt et al. | |
| 8,371,526 | B2 | 2/2013 | Shearer et al. | |
| 8,481,898 | B2 * | 7/2013 | Parker | H05B 3/22 219/484 |
| 8,764,175 | B2 | 7/2014 | Aznoe et al. | |
| 2006/0043240 | A1 | 3/2006 | Hindel et al. | |
| 2006/0201933 | A1 | 9/2006 | Carpino, II et al. | |
| 2010/0065686 | A1 | 3/2010 | Tauscher et al. | |
| 2011/0149447 | A1 | 6/2011 | Fink et al. | |
| 2015/0053664 | A1 | 2/2015 | Hu | |
| 2015/0195870 | A1 | 7/2015 | Chabach et al. | |
| 2016/0121993 | A1 | 5/2016 | Nehring | |

FOREIGN PATENT DOCUMENTS

| | | | |
|---|---|---|---|
| CN | 2630692 | Y | 8/2004 |
| CN | 201039464 | Y | 3/2008 |
| EP | 1450582 | A1 | 8/2004 |

(Continued)

OTHER PUBLICATIONS

European Search Report for European Application No. 17187661.8, dated Jan. 31, 2018.

*Primary Examiner* — Mark H Paschall
(74) *Attorney, Agent, or Firm* — Carlson, Gaskey & Olds, P.C.

(57) ABSTRACT

A heating arrangement has a positive temperature coefficient ("PTC") heater. A resistor is electrically in series with the PTC heater sized and configured to limit current through the PTC heater and the resistor below a selected value.

14 Claims, 3 Drawing Sheets

(56) References Cited

FOREIGN PATENT DOCUMENTS

| | | | |
|---|---|---|---|
| EP | 2589316 | A1 | 5/2013 |
| JP | H11201483 | | 7/1999 |
| JP | 2011134527 | A | 7/2011 |

* cited by examiner

PTC HEATER WITH AUTONOMOUS CONTROL

BACKGROUND OF THE INVENTION

This application relates to a heater formed of a positive temperature coefficient material, which has an autonomous control and protection against in-rush current.

Heaters are known and formed of a positive temperature coefficient ("PTC") material. In such heaters, current is passed between conductors which are embedded in a substrate. The substrate is formed of a material which heats when conducting electrical current. However, upon approaching a target temperature, the resistance of the material increases dramatically such that current flow then becomes limited.

One recently proposed application of a PTC heater is for heated floor panels. In such a panel, voltage is applied to the conductors and the substrate material heats. One application for such heated floor panels is in the cabin of an aircraft in the galley and near the outer doors.

SUMMARY OF THE INVENTION

A heating arrangement has a positive temperature coefficient ("PTC") heater. A resistor is electrically in series with the PTC heater sized and configured to limit current through the PTC heater and the resistor below a selected value.

These and other features may be best understood from the following drawings and specification.

DETAILED DESCRIPTION

Figure 1A:
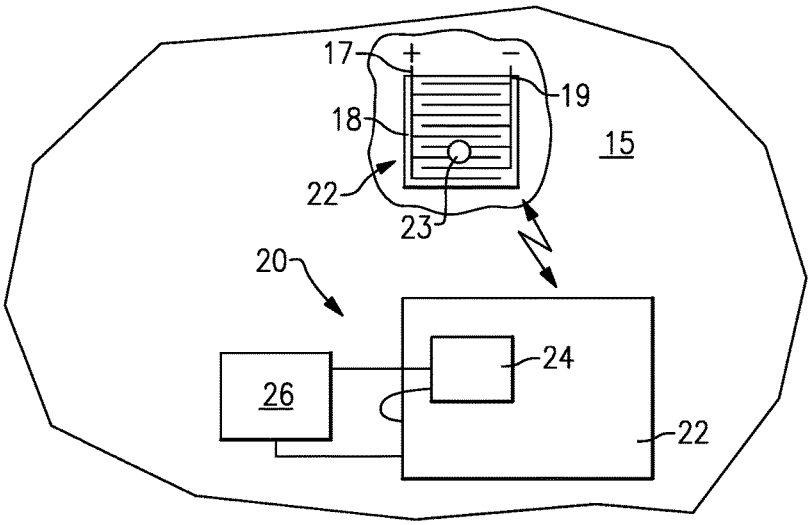
FIG. 1A schematically shows a heated floor panel.

An aircraft cabin 15 is shown schematically in FIG. 1A incorporating a heated floor panel assembly 20. The assembly 20 includes a PTC heated floor panel 22 connected in series with a resistance heater 24.

The PTC panel 22 generally includes a substrate 18 which heats when current is supplied to embedded conductors 17 and 19. A challenge exists with the use of PTC floor panels 22 due to in-rush currents at low temperatures. In addition, Applicant has recognized it may be desirable to heat the PTC panels at start-up.

As shown, a damaged area 23 could occur. As an example, a knife, or tool during maintenance, could drop in an aircraft galley location and damage the PTC heater, as shown schematically at 23.

One type of material proposed for such heaters is a printed PTC ink substrate with printed ink bus bars for the conductors 17 and 19. In such a PTC heater, the printed inks are thermoplastic, and the heat from the short circuit in the damaged area 23 could cause the bus bar to melt and re-flow. This would effectively isolate the damaged area, although no heating would subsequently occur at the damaged area 23.

PTC heaters such as described above are available from Henkel, DuPont, Pannam, and potentially other suppliers.

The PTC substrate may be formed of any number of materials. As an example, a carbon-loaded, silicone-based film may be utilized. Alternatively, an ink/paste layer may be utilized as the substrate. Also, a PTC-coated fabric may be used, as can PTC-loaded filaments, and PTC-loaded threads. The conductor spacing is selected based upon heat up rates and power density required for individual application. The PTC substrate material may also be tailored through chemistry, thickness, etc. to control heater performance.

Since the resistance heater 24 is placed in series with the heated floor panel 22, power from supply 26 passes through the resistance heater on its way to the PTC floor panel 22. Notably, the resistance heater can also be "downstream" of the PTC floor panel 22 rather than in the illustrated location. Applicant has recognized that a challenge with PTC heaters is in-rush current at low temperature operations. In the heated floor panel applications, in-rush current may be on the order of 50 amperes per panel, and can last several seconds, potentially causing nuisance circuit breaker tripping. In addition, equipment damage may also occur. Heated floor panels with conventional heaters (non-PTC) do not have these issues.

In this arrangement, the resistance heater 24 will limit the in-rush current at a cold start. The resistance heater thus provides protection against in-rush currents at low temperature conditions.

On the other hand, a resistance heater 24 on its own may utilize an undesirably high amount of current at steady state. However, as will be explained below, the PTC floor panel 22 will limit the flow of current once steady state has been reached.

Figure 1B:
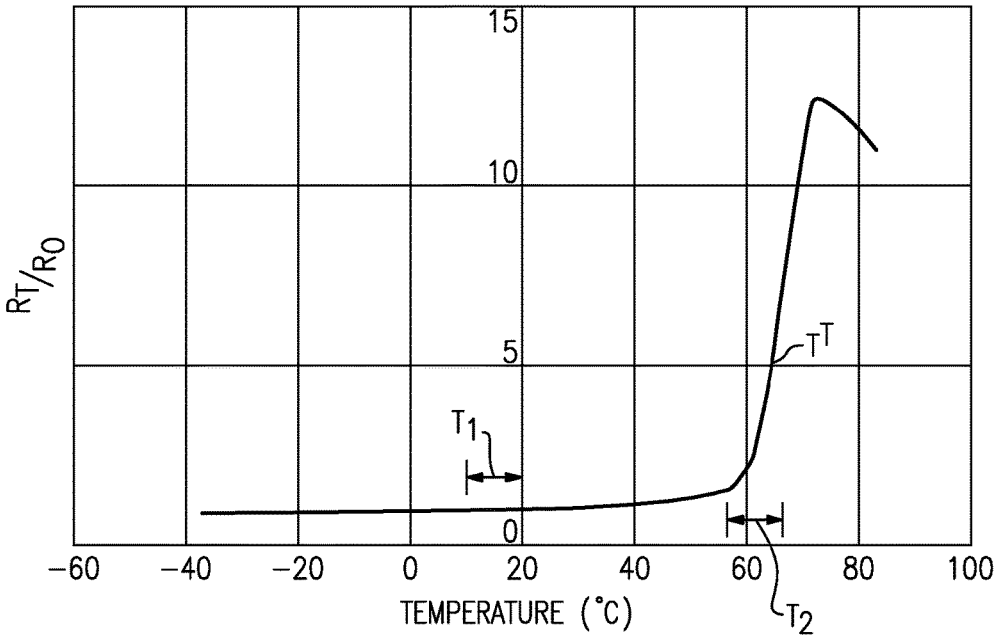
FIG. 1B shows a detail.

As shown in FIG. 1B, a resistance multiplier may be defined as the change in resistance for a given change in temperature. The term "resistance multiplier" is the resistance at a given temperature divided by the resistance at a standard temperature. As an example, FIG. 1B compares the resistance at a particular temperature ($R_T$) to a resistance at 20° C. ($R_O$). A typical curve for a PTC material is shown. At a low temperature ($T_1$) across 10° C. change, there is little or no change in the resistance. As an example, it is clear from FIG. 1B that at lower temperatures the resistance multiplier increases by a factor or less than 1 over a 10° centigrade change in temperature. As a target temperature ($T^T$) is approached, however, the resistance multiplier begins to increase dramatically.

In this region with a high rate of change, as shown across a 10° C. temperature change ($T_2$), the resistance multiplier increases from something around 1 to about 5.

Thus, PTC material as considered for this application could be defined as materials that have a relatively flat resistance until a target temperature is approached, and a resistance that increases by more than a multiplier of 2 within a 10° C. range as one approaches the target temperature. More narrowly, the PTC material could be defined as a material in which the resistance multiplier increases by a factor of 3 across a 10° C. range, and even more narrowly where the resistance changes by a factor of 5. In fact, PTC heaters exist that have resistances that increase even more dramatically.

This can be contrasted to the resistance of the resistance heater 24 which will be effectively static, and could be defined as having a resistance that will increase by less than 5% across any 10° C. change in its range of operation, and more narrowly by less than 1%.

A worker of ordinary skill in the art would know how to select the operating or target temperature, such that the heated floor panel will move to a desired temperature, and at that point its resistance will increase. Once its resistance has increased, it will limit the flow of current both to the resistance heater 24 and the PTC floor panel heater 22.

Since the resistance of the PTC panel increases dramatically, the current flow will be limited and thus the combination will provide self-regulating or autonomous control. With this arrangement, no separate controller is needed.

The resistance heater 24 can use an inherently robust pattern and should function even in the event of a broken wire/trace.

If there are a plurality of panels, they need not all be provided with a unique resistive element, provided all of the panels are in series. On the other hand, each separate panel may be provided with a unique resistive element.

Figure 2:
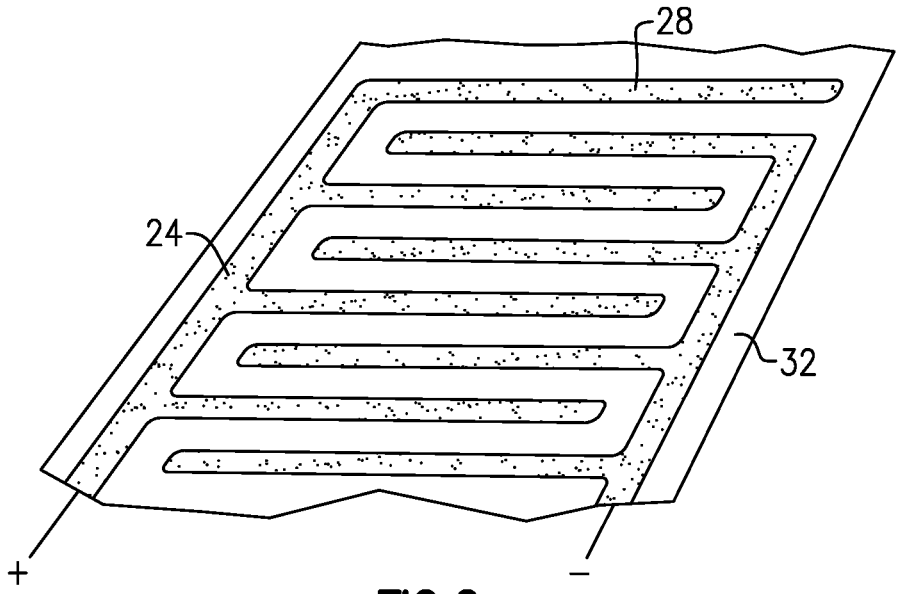
FIG. 2 shows one embodiment.

In one embodiment, as shown in FIG. 2, the resistance heater may provide both the heater function, and in addition, act as the conductors for the PTC heater. That is, the conductors for the PTC heater can be provided by a resistance heater element, as generally shown in FIG. 2. In this embodiment, as current is supplied to the resistance heater 24, it heats rapidly and will bring the substrate 32 up to temperature quickly. Of course, the same concept of a resistance heater placed onto the PTC heater may be provided more generally with separate conductors.

Figure 3:
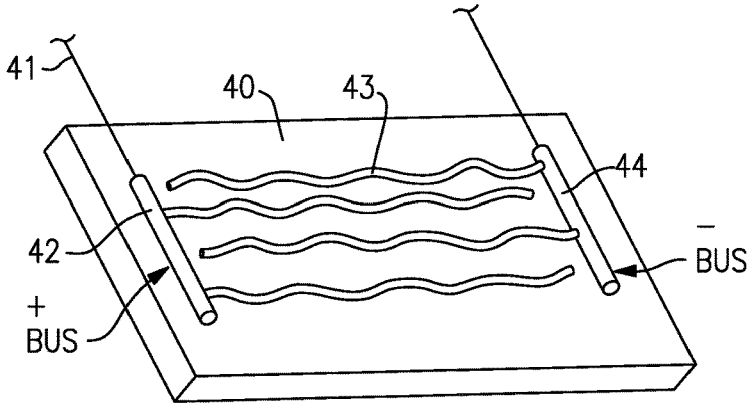
FIG. 3 shows yet another embodiment.

FIG. 3 shows another embodiment wherein resistance heater wires 43 may be sewn into the PTC panel substrate 40. Power is supplied to an input bus 42, resulting in current flow through the PTC panel substrate 40, to the output bus 44.

Figure 4:
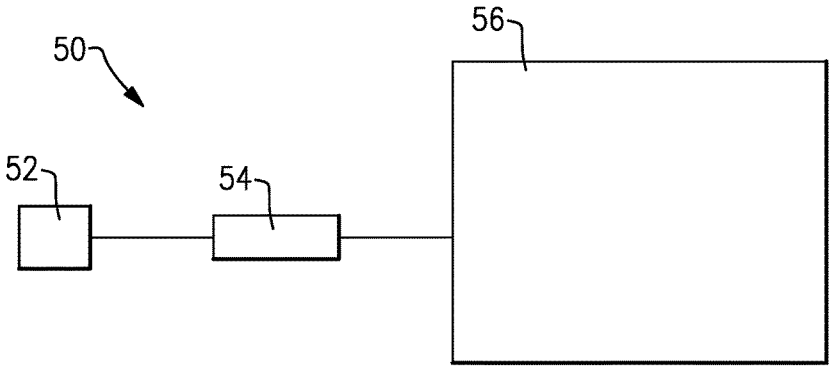
FIG. 4 schematically shows yet another embodiment.

FIG. 4 shows yet another embodiment 50, wherein a power supply 52 provides current through the resistance heater element 54, and through a PTC heater panel 56 wired in series. In this embodiment, the resistance heater 54 is quite small compared to the panel 56. This embodiment will not supply as much of the "heat up" function as described above, but will provide the in-rush current protection. Also, some heating will be provided.

Figure 5:
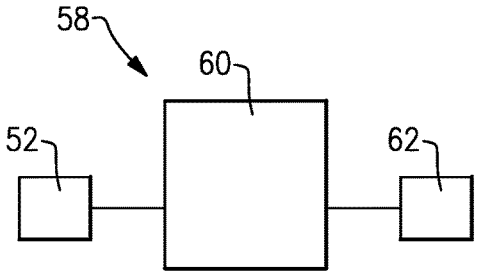
FIG. 5 shows another embodiment.

FIG. 5 shows yet another embodiment 58, wherein a power supply 52 supplies power to a resistance heating element 60, and to a PTC heater 62. As shown, the resistance heating element 60 has a much greater surface area than the PTC heater 62. However, the PTC heater 62 will provide the autonomous control to resist flow of current once a particular temperature has been reached.

The disclosed embodiments thus provide an autonomous heater combination in which no additional controls are needed.

While the disclosure is specific with regard to a heated floor panel, and in particular one for an aircraft, a number of other applications could benefit from this disclosure. As an example, heaters for various fluid transfer items such as fluid containers, pipes or hoses could benefit from a PTC heater as disclosed. In addition, aircraft structure, such as wings, or any number of other structures can benefit from heaters such as disclosed in this application. This disclosure thus extends to any application needing heating.

Further, while resistance heating elements are disclosed in the above embodiments, other type resistors may be utilized in certain applications. Thus, broadly stated, this disclosure could be said to extend to a heating arrangement including a positive temperature coefficient ("PTC") heater, and a resistor electrically in series with the PTC heater, sized and configured to limit current through the PTC heater and the resistor below a selected value. In further embodiments, the selected value may be determined by parameters of a specific application. Examples of the parameters may include the material of the PTC heater, the area of the PTC heater, a maximum acceptable operating current for the PTC heater, and the current available from a power supply in use with the heating arrangement. In addition, the materials chosen around the heater could also impose limits on the amount of heat generated that could be a parameter. Also, a parameter may be a circuit breaker or other protective device which will open a circuit when the current goes above a given threshold. In one embodiment, the resistor may also be a negative temperature coefficient element.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A heating arrangement comprising:

a positive temperature coefficient ("PTC") heater;

a resistor electrically in series with the PTC heater sized and configured to limit current through the PTC heater and the resistor below a selected value;

wherein said PTC heater is utilized as a floor panel;

wherein said PTC heater has a resistance multiplier that is relatively static at lower temperatures, but increases by a factor of at least 2 across a 10° C. temperature increase as a target temperature is approached; and wherein said PTC heater has a surface area, and said resistor is a resistance heating element which is within said surface area.

2. The heating arrangement as set forth in claim 1, wherein said selected value is determined by parameters of a specific application.

3. The heating arrangement as set forth in claim 2, wherein at least one of the parameters is a material of the PTC heater.

4. The heating arrangement as set forth in claim 2, wherein at least one of the parameters is said surface area of the PTC heater.

5. The heating arrangement as set forth in claim 2, wherein at least one of the parameters is a maximum acceptable operating current for the PTC heater or resistor.

6. The heating arrangement as set forth in claim 2, wherein at least one of said parameters is a current available by a power supply in use with the heating arrangement.

7. The heating arrangement as set forth in claim 2, wherein the heater has a circuit, and at least one of said parameters is a current threshold that would cause a protective device to open said circuit associated with the heater.

8. The heating arrangement as set forth in claim 1, wherein said resistor is a negative temperature coefficient element.

9. The heating arrangement as set forth in claim 1, wherein said resistance heating element is placed on a surface of said PTC heater.

10. The heating arrangement as set forth in claim 1, wherein said PTC heater has a substrate, and said resistance heating element is formed by wires which are incorporated into the substrate of said PTC heater.

11. The heating arrangement as set forth in claim 1, wherein said resistor has a surface area that is smaller compared to said surface area of said PTC heater.

12. The heating arrangement as set forth in claim 1, wherein said resistor also provides conductors within a PTC substrate material, such that said resistor is also an operative component of the PTC heater.

13. The heating arrangement as set forth in claim 1, wherein said PTC heater includes printed PTC ink for a substrate, with printed ink bus bars, and said PTC heater has a self-isolating function in a damaged area causes a short circuit, with the short circuit causing a flow of a material of said substrate to close the short circuit.

14. The heating arrangement as set forth in claim 1, wherein said resistance multiplier is defined as a resistance at a given temperature divided by a resistance at a standard temperature, and said relatively static resistance multiplier is less than 1 across a 10° centigrade range at relatively lower temperatures below a target temperature, and said resistance multiplier increases by a factor of at least 3 across a 10° centigrade range as one approaches said target temperature.

* * * * *